US005689883A

United States Patent [19]

Ortiz et al.

[11] Patent Number: 5,689,883

[45] Date of Patent: Nov. 25, 1997

[54] SHAVING IMPLEMENT

[75] Inventors: Ernest A. Ortiz, Cheshire; Evan N. Chen, Fairfield, both of Conn.

[73] Assignee: Warner-Lambert Company, Morris Plains, N.J.

[21] Appl. No.: 439,058

[22] Filed: May 8, 1995

[51] Int. Cl.[6] ..... B26B 21/06; B26B 21/40

[52] U.S. Cl. ..... 30/34.2; 30/50; 30/81

[58] Field of Search ..... 30/34.2, 47–50, 30/81–82, 77

[56] References Cited

U.S. PATENT DOCUMENTS

| | | | |
|---|---|---|---|
| 1,651,917 | 12/1927 | Connolly | 30/81 |
| 2,068,085 | 1/1937 | Stanley . | |
| 2,300,794 | 11/1942 | Martin . | |
| 2,374,612 | 4/1945 | Mellon . | |
| 2,548,959 | 4/1951 | Eisenberg et al. . | |
| 2,568,047 | 9/1951 | Anderson . | |
| 2,766,521 | 10/1956 | Benvenuti . | |
| 2,817,146 | 12/1957 | Roberts . | |
| 3,138,865 | 6/1964 | Meyer . | |
| 3,722,090 | 3/1973 | Dawidowicz . | |
| 3,909,939 | 10/1975 | Dootson . | |
| 4,189,832 | 2/1980 | Harper et al. . | |
| 4,310,968 | 1/1982 | Buik et al. . | |
| 4,741,103 | 5/1988 | Hultman . | |
| 4,998,347 | 3/1991 | Schachter | 30/34.2 |
| 5,141,694 | 8/1992 | Butlin et al. . | |
| 5,185,927 | 2/1993 | Rivers . | |
| 5,191,712 | 3/1993 | Crook et al. . | |
| 5,249,361 | 10/1993 | Apprille et al. . | |
| 5,546,660 | 8/1996 | Burout et al. | 30/50 |

FOREIGN PATENT DOCUMENTS

| | | |
|---|---|---|
| 0254491 | 7/1987 | European Pat. Off. . |
| 0254491 | 1/1988 | European Pat. Off. . |
| 0366139 | 5/1990 | European Pat. Off. . |
| 0397638 | 11/1990 | European Pat. Off. . |
| 2323502 | 9/1976 | France . |
| 5496694 | 3/1994 | Japan . |
| 1557177 | 12/1979 | United Kingdom . |
| WO8102864 | 10/1981 | WIPO . |
| WO9323214 | 11/1993 | WIPO . |
| WO9404325 | 3/1994 | WIPO . |
| WO9417967 | 8/1994 | WIPO . |

*Primary Examiner*—Douglas D. Watts
*Attorney, Agent, or Firm*—Charles W. Almer

[57] ABSTRACT

A shaving implement, such as a disposable cartridge or razor, comprises a shaving head which includes a skin-contacting element, in the form of a plurality of sections of flexible ridges. The ridges in each section are oriented alternately at positive and negative angles relative to the blade, in a herringbone pattern, and define flow-through recesses. Preferably, a ridge from each section is joined together with a ridge from an adjoining section, to form a chevron-shaped node between sections. When shaving, adjacent sections push areas of the skin in different directions, while the flow-through channels retain a layer of lubricating material on the skin, so that the cartridge provides a smooth, comfortable shave.

40 Claims, 9 Drawing Sheets

SHAVING IMPLEMENT

FIELD OF THE INVENTION

The present invention is directed to wet shaving systems, and in particular to shaving implements, such as disposable razors or cartridges, having one or more razor blade cutting edges disposed between a guard and a cap.

BACKGROUND OF THE INVENTION

In conventional wet shaving systems, a razor includes a handle and a shaving head. The shaving head, which may be either unitary with the handle or a separate, replaceable cartridge, houses one or more razor blades and includes a guard and cap on opposite sides of the blade cutting edge so as to maintain the blade edge at a predetermined spacing and angle relative to the skin.

The guard is disposed below the blade, forward of the blade cutting edge, to engage the skin prior to the blade. In addition to defining the shaving geometry as described above, the guard acts to pre-stretch the skin by a predetermined amount, so as to allow the blade to shave the skin closely and safely.

Normally, the skin-engaging surface of the guard is textured in some manner, for example to employ horizontal fins or ribs, such as disclosed in U.S. Pat. No. 3,939,560. Because the guard is normally part of the razor head or cartridge, the projections are metal or a hard plastic.

There have, however, been proposals to provide a guard which is a separate element from the shaving head, in order that the guard may be formed of an elastomeric material. For example, U.S. Pat. No. 2,548,959 discloses a metal razor having a guard elements made out of rubber. The rubber guard elements are either mechanically attached to the head or glued to the metal guard.

There is currently on the market a razor cartridge which includes a resilient guard element in the form of a plurality of rows of flexible fins that extend parallel to the blade edge, as disclosed in U.S. Pat. No. 5,191,712 and U.S. Pat. No. 5,249,361. In the cartridge disclosed in the '361 patent, in order to attach the resilient guard element to the plastic cartridge body, the guard is formed of two parts, namely, a skin-engaging portion formed of elastomeric material and a base portion of rigid plastic material. The rigid plastic base portion is provided with latch members so that the guard assembly can be snapped onto a blade cartridge body.

It would be desirable to provide a shaving implement having a guard with a surface formed of flexible skin-engaging members to pre-stretch the skin prior to being shaved by the razor blade, which provides a very stable structure that can be mass produced in an economical and high quality manufacturing process, and which minimizes parts handling, feeding, and subassembly requirements normally required for a cartridge.

It would also be desirable to provide an array of skin-contacting members on the guard which pre-stretch the skin in an improved manner and deliver additional, previously undetected, consumer benefits related to close and comfortable shaving.

SUMMARY OF THE INVENTION

A shaving implement such as a disposable razor or razor cartridge according to the invention comprises a shaving head which includes a cap portion, a guard portion, and at least one razor blade. The shaving head includes a skin-contacting element and is preferably formed of an elastomeric material which is insert molded into one or more recesses in the guard to extend across the shaving head.

The skin-contacting element includes a plurality of skin-contacting ridges extending at an angle relative to the direction of the blade edge, in order to define a plurality of flow-through channels extending from the leading edge to the trailing edge of the skin-contacting element. Most preferably, the skin-contacting element is in the form of a plurality of rows of ridges or projections, oriented alternately at positive and negative angles, in a herringbone pattern. Also, at least one ridge from each section is joined together with a ridge from an adjoining section, to form a chevron-shaped node between adjoining sections.

Due to the alternating angles of the ridges, different regions of the skin-contacting element push the skin in different directions, and the chevrons form stiffening nodes that reduce locally the flexibility of the ridges. Moreover, the fact that the ridges extend at an angle to the blade edge, and define flow-through channels, act to condition the skin surface, in preparation for the blade, in a novel way.

The present invention employs ridges which preferably have a lower aspect ratio and which are stiffer than the fins used in the product currently on the market. The inventors have found that, in contrast to the product presently being marketed, where the flexible fins are perpendicular to the shaving direction and act like wiper blades to remove shaving cream and other lubrication prior to the blade shaving the skin, the flow-through channels of the present invention leave a layer of lubricating material on the skin. Moreover, different areas of the skin-contacting element push the skin in different directions, and the invention provides a pleasant and comfortable shave.

The present invention has additional advantages when used in flexible razor cartridges. Such cartridges have a cartridge body which is flexible in a direction perpendicular to the blade, so that the blade can conform to the various contours of the face or other shaving surface. If a skin-contacting element having fins parallel to the blade edge were to be used in a flexible cartridge, the fins would act as stiffening ribs against flexing of the cartridge, thus interfering with its normal operation. In contrast, because the ridges in the present invention do not extend continuously across the guard, but rather define flow-through channels, the skin-contacting element of the present invention is quite flexible in the normal flexing direction of the cartridge.

The recess in the guard for receiving the skin-contacting element may include, in addition to a seat portion, a joint forming portion for forming a mechanical joint, e.g., in a dovetail shape between the skin-contacting element and the guard. The skin-contacting element is insert molded onto the guard portion so as to fill the recess, such that the portion disposed in the dovetail portion forms a dovetail joint to help secure the skin-contacting element in place.

The guard supporting the skin-contacting element is preferably a plurality of guard segments, arranged parallel to the seat blade edge and having gaps therebetween. Each guard segment is supported by a rib that extends forwardly from a respective rigid seat segment, and is provided with a recess for securing the skin-contacting element.

The skin-contacting element may comprise a plurality of segments secured to individual guard segments. However, as discussed above where the skin-contacting element is elastomeric, it is very flexible due to the the flow-through channels, and therefore the skin-contacting element may advantageously extend continuously across the shaving head as a continous element. A skin-contacting element may be secured to the cap as well, either as an alternative to a skin-contacting element on the guard or in addition thereto.

For a better understanding of the invention, reference is made to the following detailed description of preferred embodiments, taken in conjunction with the drawings accompanying the application.

DETAILED DESCRIPTION OF PREFERRED EMBODIMENTS

Figure 1:
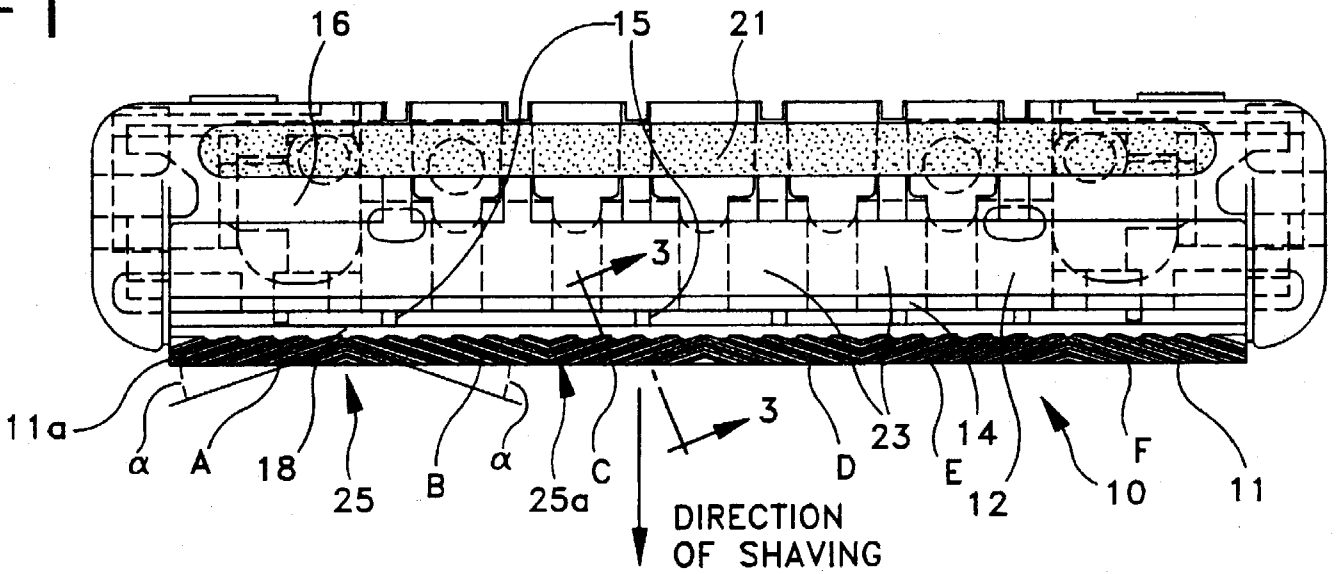
FIGS. 1 and 2 are top and front views, respectively, of a flexible razor cartridge according to the invention.
Figure 2:
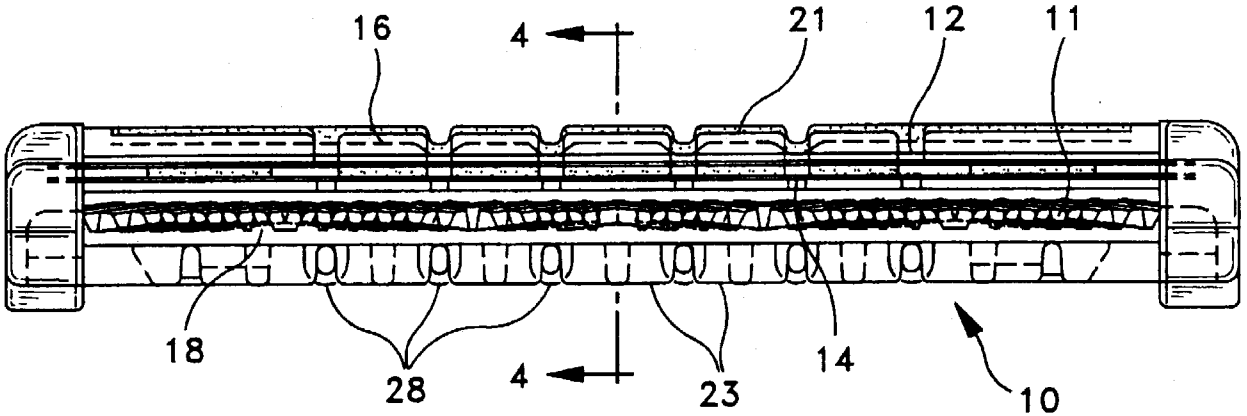

FIGS. 1–4 illustrate an insert molded, flexible razor cartridge 10 including a pair of single edge blades 12, 14, a cap 16, and a guard 18 which is supported forward of and below the blades 12, 14 by a plurality of ribs 15. The lower blade 14, or "seat blade", is supported on a seat 20 (see FIG. 4), whereas the upper blade 12, or "cap blade", is spaced above the seat blade 14 by a plurality of spacer elements 22. The cap is preferably molded as a plurality of segments, having gaps therebetween, to facilitate flexing of the cartridge 10, and includes a shaving aid 21, described further below.

In the example of the flexible cartridge shown in FIGS. 1–4, the seat 20 is formed by a plurality of rigid segments 23, which are connected by flexible webs 28 to allow the cartridge 10 to bend in a direction perpendicular to the longitudinal axis of the blades 12, 14. Examples of razor systems which employ a flexible blade cartridge are disclosed in Cartwright et al. U.S. Pat. No. Re. 30,913, Motta et al. U.S. Pat. No. 4,443,939, and Butlin et al. U.S. Pat. No. 5,141,694, and need not be described further here. Such razor systems allow the blade to follow the contours of the skin when shaving the face and provide a better shave.

Figure 3:
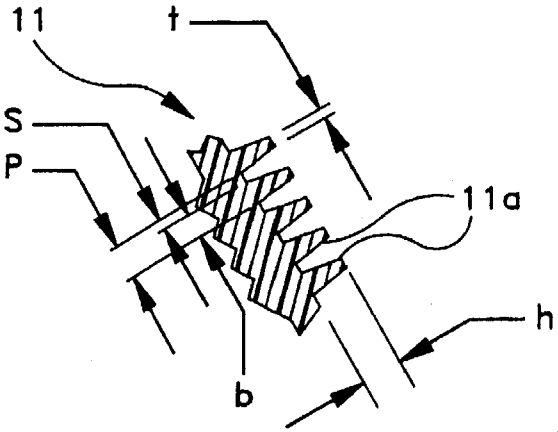
FIG. 3 is an enlarged, sectional view of the skin-contacting element of FIGS. 1–2, taken through lines 3—3 of FIG. 1.

The guard 18 includes a skin-contacting element 11 which includes a base 27 (see FIG. 4) and a plurality of rows of ridges 11*a* (see FIG. 3). The guard 18 includes a recess 29 for receiving the base 27 so that the ridges 11*a* project from the guard 18 and form a skin-contacting surface. The ridges 11*a* are arranged in a herringbone pattern and thus are divided into a plurality of adjacent segments A–F in which the ridges 11*a* extend alternately in directions $\alpha$ and $\alpha'$ relative to the direction parallel to the blades, in which angle $\alpha$ is a positive, acute angle and $\alpha'$ is a negative, acute angle relative to the direction of the blade edge.

Preferably, adjoining segments AB, BC, CD, DE, and EF are mirror images of one another and include a chevron-shaped node 25, 25*a* at each pair of adjoining sections, which nodes 25, 25*a* are oriented alternately in and opposite to the direction of shaving. In the preferred embodiment, the ridges 11*a* lie alternately at positive and negative angles in the range of 10° to 50°. Most preferably, the ridges 11*a* in adjoining sections lie alternately at angles of +20° and −20° relative to the directions of the blade edges.

Figure 1A:
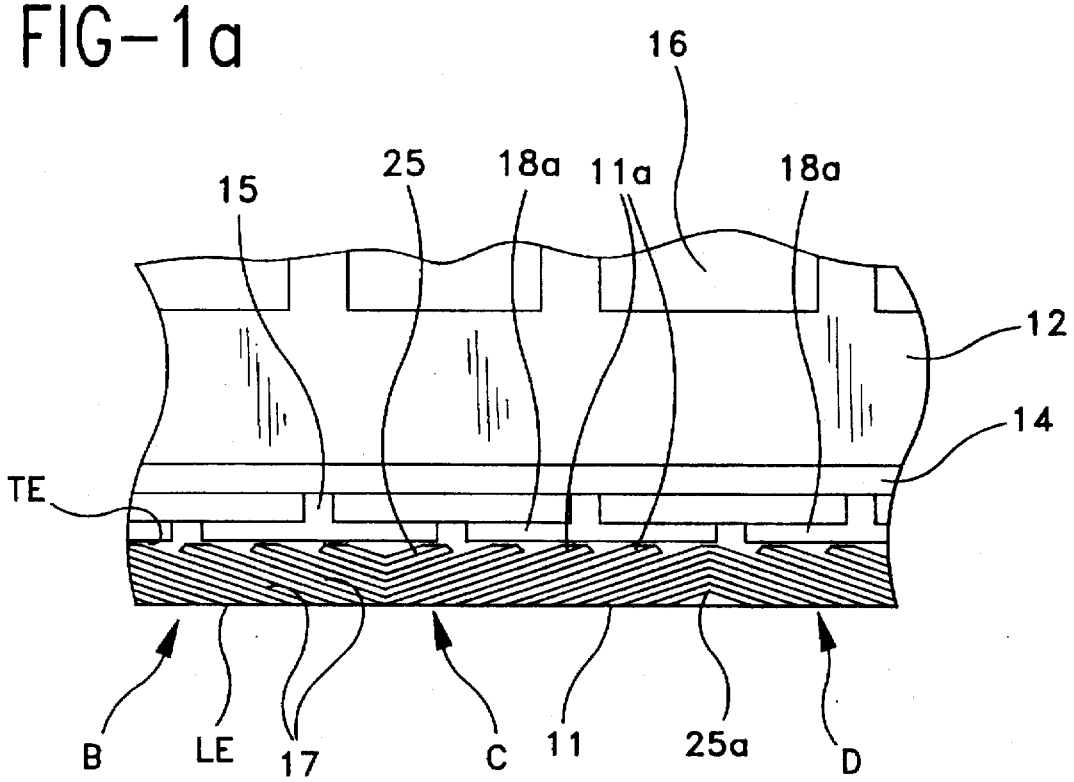
FIGS. 1*a* and 2*a* are enlarged top and front views, respectively, of a portion of the cartridge of FIGS. 1–2.
Figure 2A:
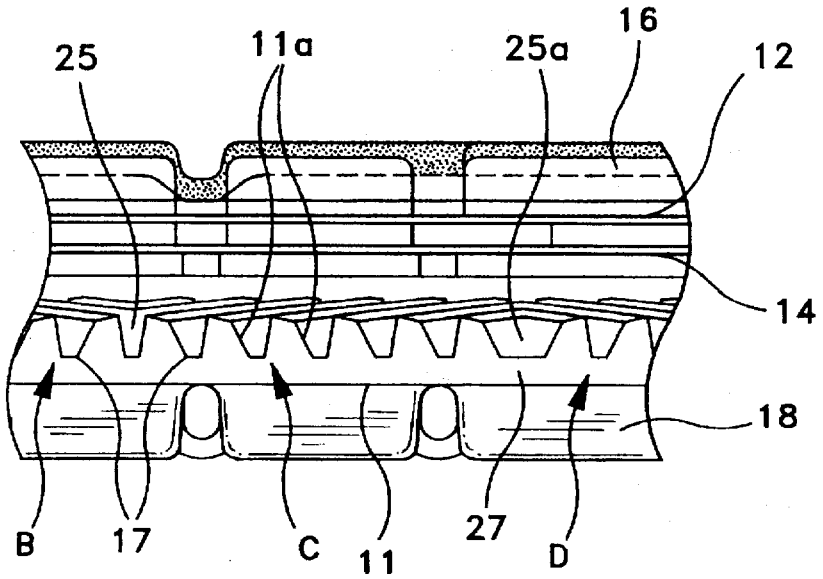

As shown in FIG. 1*a*, the ridges 11*a* define a plurality of flow-through channels extending from the leading edge "LE" to the trailing edge "TE" of the skin-contacting member. As also shown in FIG. 1*a*, the space between adjacent guard segments 18*a* is filled with a portion of the skin-contacting element, which provides control of the flow of the skin ahead of the blade edges while improving the flexibility of the cartridge. The feature also helps secure the element in place.

The guard portion 30 includes an outermost guard surface 46 (see FIG. 4) lying generally along a tangent between the cap portion 16 and the resilient skin-contacting element 11. The guard surface 46 limits the degree to which the razor can be pressed into the skin, to protect the skin from cuts and nicks. However, if, as in the preferred embodiment, nodes 25, 25*a* are formed across the skin-contacting element, it is not necessary to provide a guard surface 46, because the non-yielding nodes 25, 25*a* will perform the protective function.

Preferably, the skin-contacting element 11 is formed of an elastomeric material which will chemically bond with the surfaces forming the recess 29 in the guard 18. In the guard 18 shown in FIG. 4, the recess 29 is partially inset into the guard 18 so as to have three surfaces (opposed horizontal top ledge 36*a* and bottom ledge 36, and vertical back wall 37) to secure the base 27 of the skin-contacting element 11. The preferred materials, where the guard 18 is made of polypropylene, is a thermoplastic rubber such as Hercuprene 1000, 3000 series, Durometer 30 to 90 A scale; Kraton G series, Durometer 30 to 90 A scale; and Santoprene 2271 series, Durometer 30 to 90 A scale. Most preferably, a thermoplastic rubber, having a durometer of 45 Shore A scale, is used.

In the exemplary embodiment of FIGS. 1–4, the ridges 11*a* have a height "h" of 0.025 inches (0.635 mm) and a pitch "p" of 0.020 inches (0.51 mm). The ridges 11*a* taper from a thickness "b" of 0.015 inches (0.38 mm) at the base to a the thickness "t" at the tip of 0.005 inches (0.13 mm), and there is a spacing "s" of 0.005 inches (0.13 mm) between rows. The height, taper and spacing may be varied depending upon the resiliency of the material used. However, preferably the ridges have a height "h" between 0.56 and 0.71 mm, an aspect ratio (ratio of height "h" to base thickness "b") between 1.5 and 1.9, and a pitch "p" between 0.254 and 0.51 mm.

Due to the herringbone ridge pattern, when the razor moves in the direction of shaving, the segments A–F of the skin-contacting element 11, rather than flexing in the opposite direction of shaving (as would occur if the rows were parallel to the direction of the blade edges), will flex at angles of 70° and 290°, respectively, relative to the direction of shaving. Moreover, at the chevron-shape nodes 25, 25*a*, flexure does not occur. As can be seen from FIG. 1, the chevrons form alternating "Λ" (25) and "V" (25*a*) nodes between adjoining rib segments. When the node "V" 25*a* is pointing in the direction of shaving, the "V" intersection 25*a* acts like a snowplow and spreads the skin apart, thereby stretching the skin. Alternatively, when the node "Λ" 25 is pointing away from the direction of shaving, the "Λ" shape tends to bunch the skin together. The applicants have found that this alternating stretching and bunching of areas of the skin, prior to encountering the blades 12, 14, tends to produce better performance and a closer shave.

Figure 4:
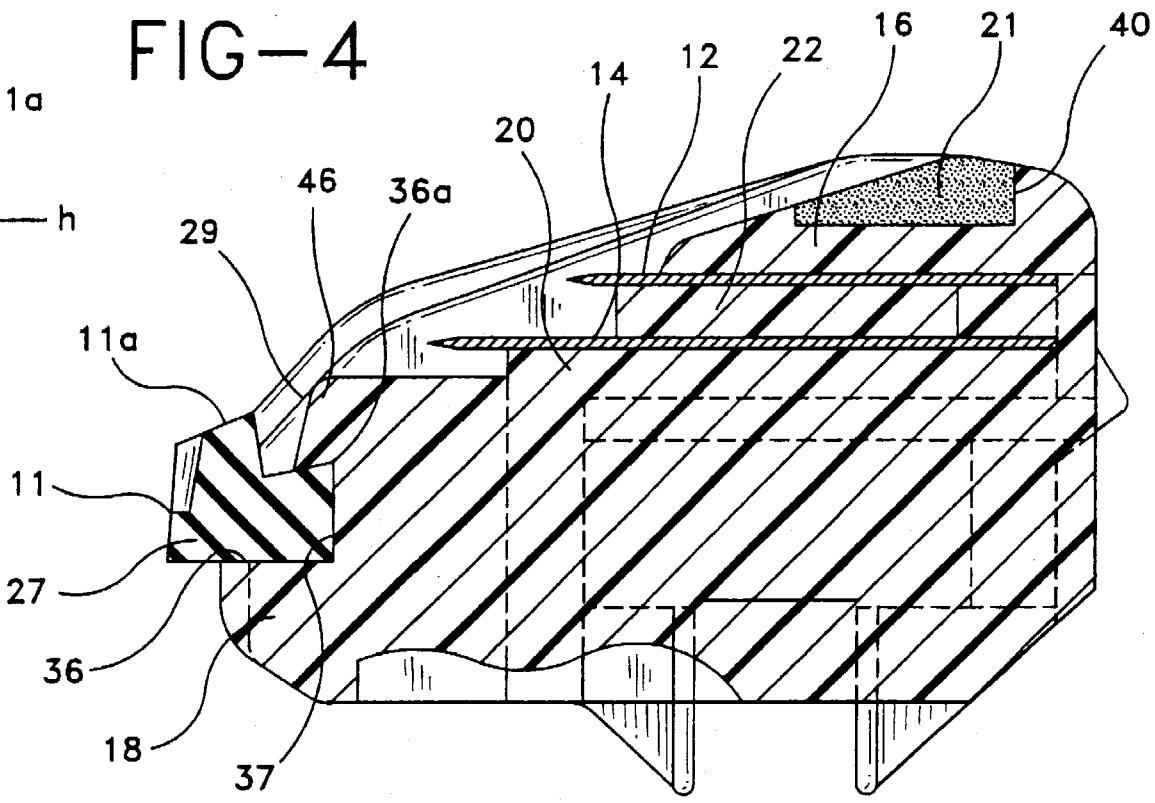
FIG. 4 is an enlarged, sectional view of the cartridge of FIGS. 1–2, taken through lines 4—4 of FIG. 2.

In accordance with generally known insert molding processes, the blades 12, 14 are positioned in a cartridge forming mold, and liquid plastic, preferably polypropylene, is injected to form seat 20, cap 16, spacers 22, and guard 18 and, in so doing, secure the blades 12, 14 as shown. The guard 18 is molded so as to form the recess 29 extending across the front surface of guard 18, including a horizontal ledge 36, a vertically extending rear wall 37, and a top ledge 36*a*, such that the recess 29 is partially inset into the guard 18 as shown in FIG. 4. Insert molding to form razor cartridges per se is generally known and therefore need not be described in detail here. For an example of a suitable insert molding process, see U.S. Pat. No. 5,141,694. After the cartridge unit has been thus molded, the skin-contacting element 11 is insert molded so as to fill the recess 29.

Figure 5:
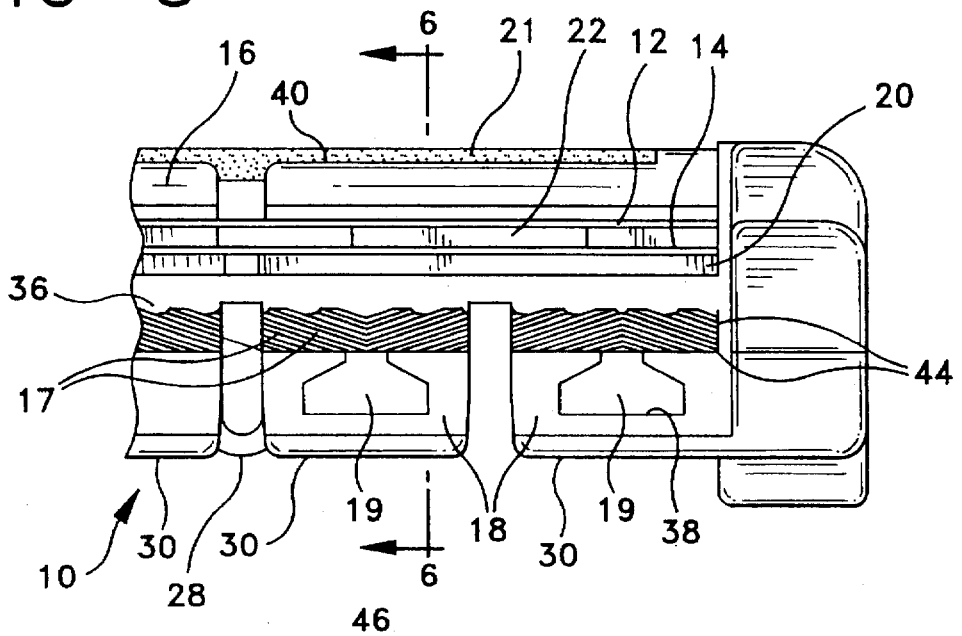
FIG. 5 is an enlarged, front view of a portion of a second embodiment of a flexible razor cartridge.
Figure 6A:
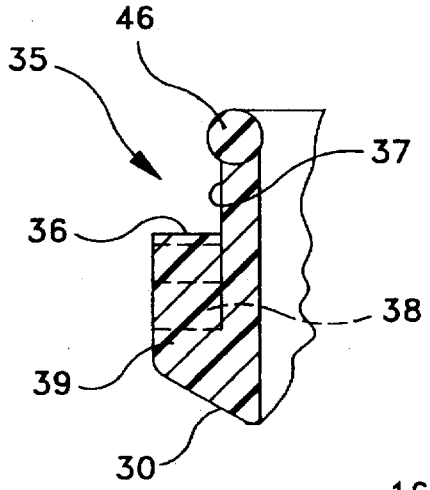
FIG. 6*a* is a partial view of the cartridge of FIG. 6, prior to securing the skin-contacting element.
Figure 6:
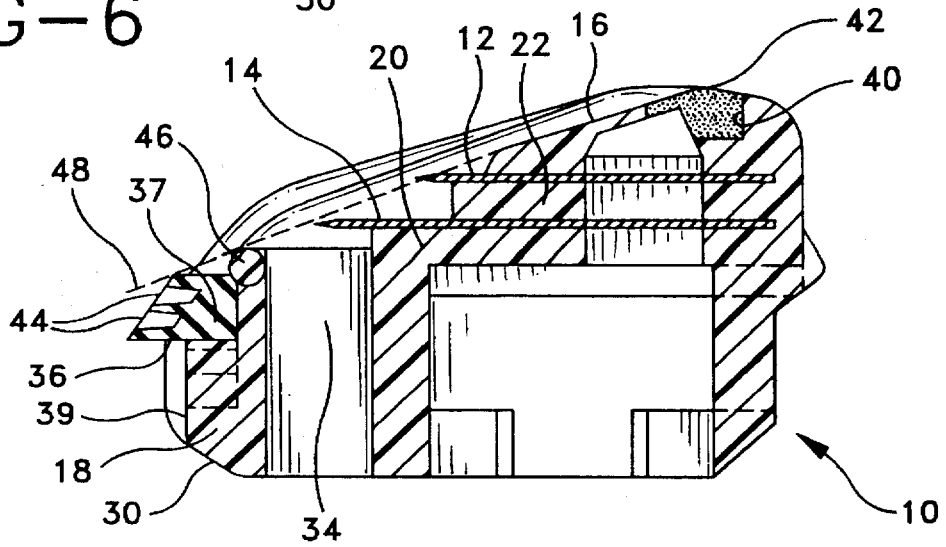
FIG. 6 is a side, sectional view of the cartridge, taken through lines 6—6 of FIG. 5.

The flexible cartridge shown in the embodiment of FIGS. 5–6 is similar to the embodiment of FIGS. 1–4, except that the guard 18 comprises a plurality of individual guard segments 30, each supported by a forwardly extending rib 34, instead of a single guard element, and the recess for securing the skin-contacting element to each guard segment is shaped so as to form a dovetail mechanical joint. Also, FIGS. 5–6 illustrate an alternative embodiment of the skin-contacting element.

As shown in FIG. 6*a*, each guard segment 30 includes a forward facing recess 35. The recess 35 includes a seat portion, formed a by horizontal ledge 36 and a vertically extending rear wall 37 at the rear of the ledge, and the ledge 36 extends rearwardly from the front face 39 of the guard segment 30, similar to FIGS. 1–4. The recess 35 further includes, however, a joint-forming portion 38, in the shape of a dovetail., located below the seat portion.

A skin-contacting element segment 19 is injection molded so as to fill the seat and joint-forming portions of the recess 35 of each guard segment 30. Each skin-contacting element segment 19 has a skin contacting surface that is disposed forward of and below the cutting edge of the seat blade 14. The portion of the skin-contacting element segment 19 filling the joint-forming recess 38 forms a dovetail joint.

The embodiment of FIGS. 5–6 may be formed in a manner similar to FIGS. 1–4 except that, in addition to the main body of the skin-contacting segment (which is supported in the seat portion of the recess), a dovetail shaped extension is disposed in joint-forming portion 38 to form the dovetail joint 38.

In the example of FIGS. 5–6, the skin-contacting element 19 includes a plurality of ridges 44, which are similar to the ridges of FIGS. 1–4 except that they project forward, parallel to the blades, rather that being oriented upwardly as in FIGS. 1–4. Each row of ridges 44 extends outward a greater distance than the row immediately above it. Rather than extending parallel to the blades, the ridges can be inclined at angle to the horizontal.

Figure 7:
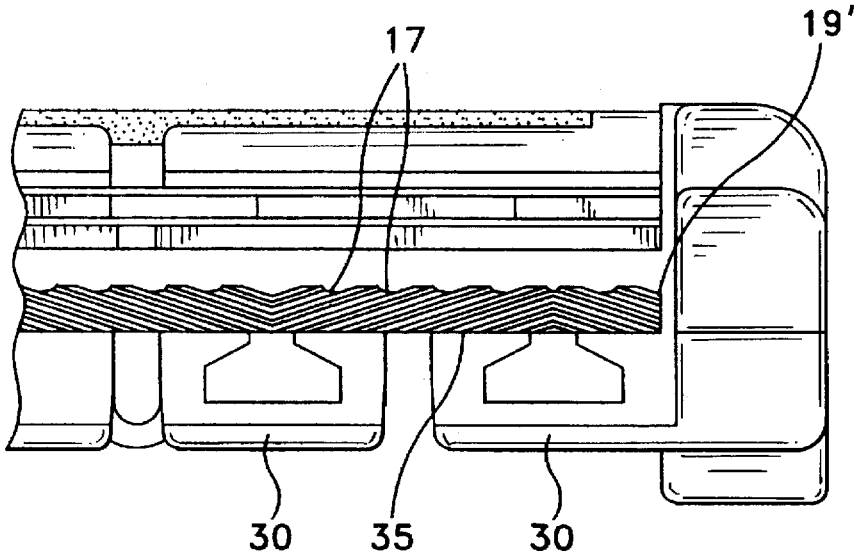
FIG. 7 is an enlarged, front view of a portion of a razor cartridge, illustrating a third embodiment of the invention.

FIG. 7 illustrates a third embodiment, which is similar to FIGS. 5–6 except that the skin-contacting element 19' extends continuously across the width of the cartridge. The skin-contacting element 19' is insert molded onto the guard segments. One embodiment may include the guard segment 30, so as to be disposed in the recess 35 and form a dovetail joint with each guard segment 30. in the skin-contacting element 19' as shown, the ridges project forward, parallel to the blades. However, the ridges may be oriented vertically, as in FIGS. 1–4.

Figure 8:
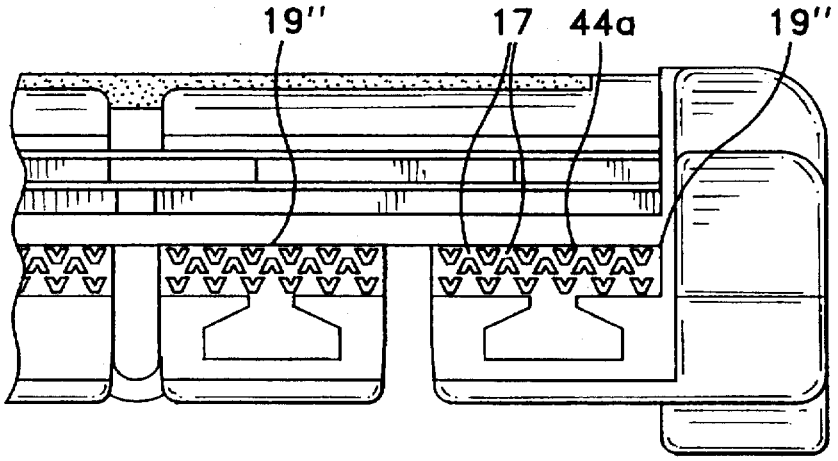
FIG. 8 is an enlarged, front view of a portion of a razor cartridge, illustrating a fourth embodiment of the invention.

FIG. 8 illustrates a fourth embodiment in which the skin-contacting segments 19" include an array of ridges at alternating angles forming small chevrons 44*a* that project forward of the cartridge. Preferably, each horizontal row of chevrons 44*a* projects outwardly a greater distance than the row above it. As in the prior embodiments, rather than facing forward the chevrons 44*a* can extend upwardly, perpendicular to the blades.

Figure 9:
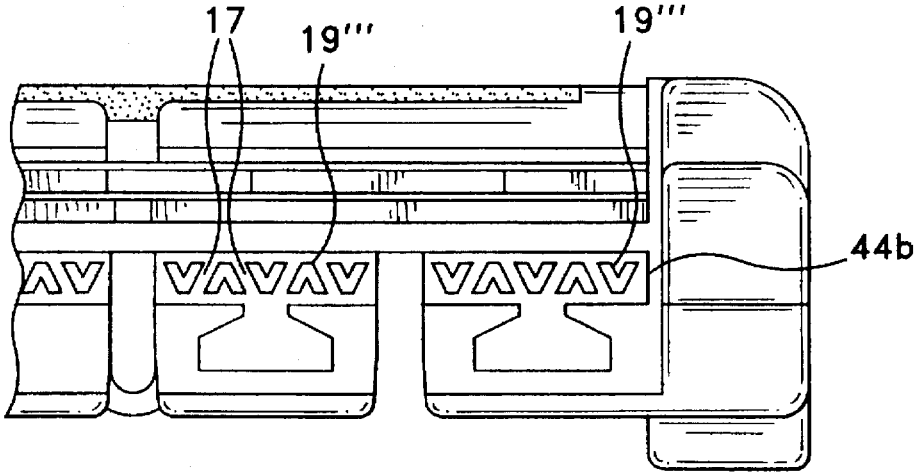
FIG. 9 is an enlarged, front view of a portion of a razor cartridge, illustrating a fifth embodiment of the invention.

FIG. 9 illustrates a fifth embodiment, containing skin contacting elements 44*b* comprising a single row of ridges, arranged in pairs to form chevron shaped nodes 19'", successive chevrons 19'" pointing in opposite directions. As in the prior embodiments, rather than facing forward the chevrons 19'" can extend upwardly, perpendicular to the blades.

Figure 10:
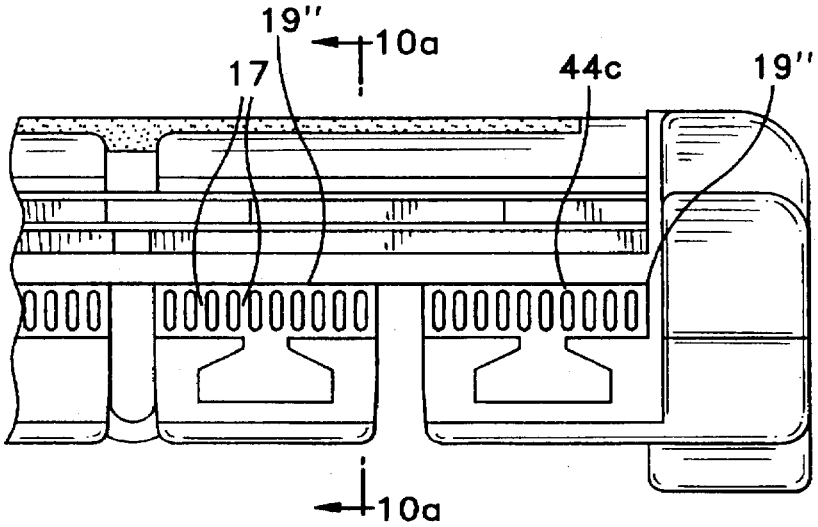
FIG. 10 is an enlarged, front view of a portion of a razor cartridge, illustrating a sixth embodiment of the invention.

FIG. 10 illustrates a sixth embodiment in which a plurality of vertically oriented ridges 44*c* are spaced across each skin-contacting elements $19^{IV}$. Again, the ridges are shown projecting forward, but can alternatively face upwardly.

Figure 10A:
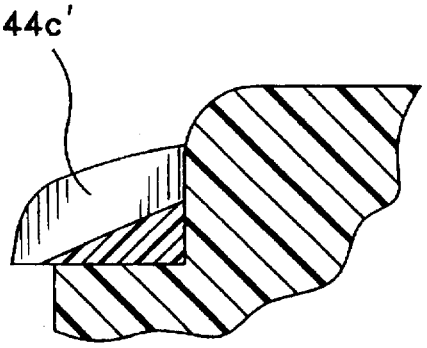
FIG. 10*a* is a sectional view, taken through lines 10*a*—10*a* of FIG. 10, of a slightly varied embodiment of FIG. 10.
Figure 10B:
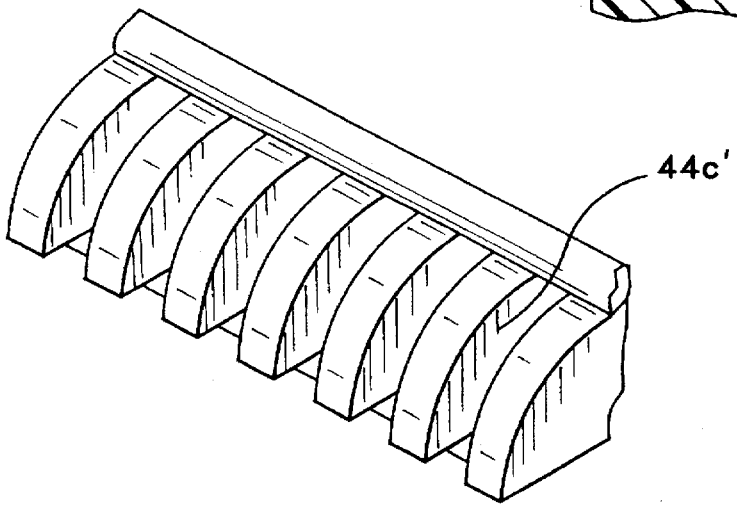
FIG. 10*b* is a perspective view of a portion of the skin-contacting member of FIG. 10*a;*

FIGS. 10*a* illustrates a modification of FIG. 10, taken through lines 10*a*—10*a* of FIG. 10. The embodiment of FIG. 10*a* is the same as FIG. 10, except that the ridges 44*c'* are vertically oriented rather than facing forward (as in FIG. 10). FIG. 10*b* is a perspective view of the ridges 44*c'* of FIG. 10*a*.

Figure 11:
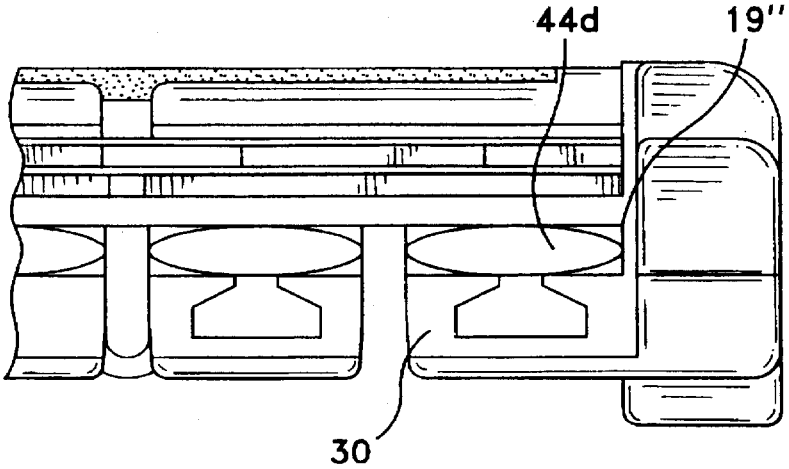
FIG. 11 is an enlarged, front view of a portion of a razor cartridge, illustrating a seventh embodiment of the invention.

In the seventh embodiment, shown in FIG. 11, each skin-contacting segment 30 has a skin-contacting element segment $19^{V}$ with an outwardly projecting, elliptical bulge 44*d*. The segments $19^{V}$ thus form a plurality of spaced skin contacting members across the width of the cartridge. In this embodiment too, the skin engaging elements, bulges 44*d*, can be oriented to face upwardly rather than forward.

Figure 12:
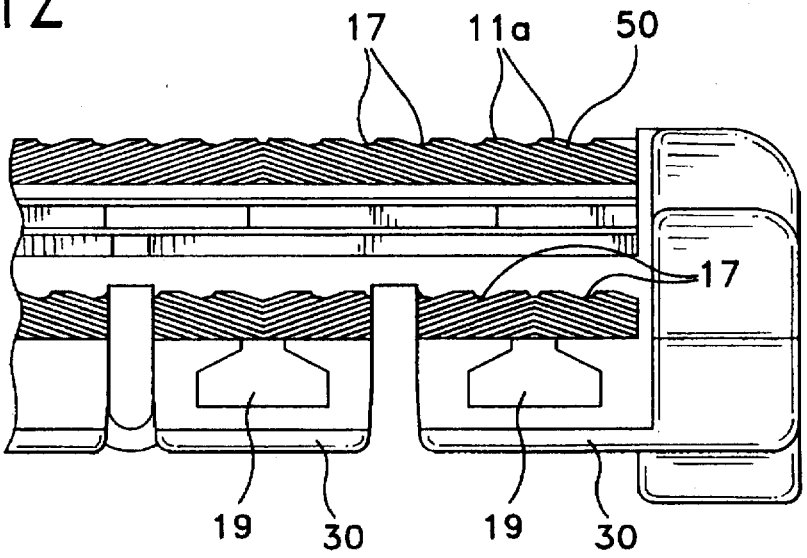
FIG. 12 is an enlarged, front view of a portion of a razor cartridge, illustrating an eighth embodiment of the invention.

FIG. 12 illustrates an eighth embodiment where, in addition to skin-contacting segments 19 on the guard segments 30, a second skin-contacting element 50 is molded into the cap 16. As in the case of skin-contacting segments 19, the skin-contacting element has a plurality of rows of ridges 11*a* that are arranged in a pattern similar to the ridges 11*a* of FIG. 1, such that the ridges 11*a* define flow-through channels 17. The cap 16 is formed with a recess (not shown) to receive the base of the skin-contacting element 50, which may be similar to recess 29 of FIG. 4, or may include a joint portion such as recess 38 of FIG. 6*a*. Moreover, if desired a skin-contacting element 50 may be used in the cap 16 without skin-contacting elements 19, in which case a conventional guard would be employed.

Figure 13:
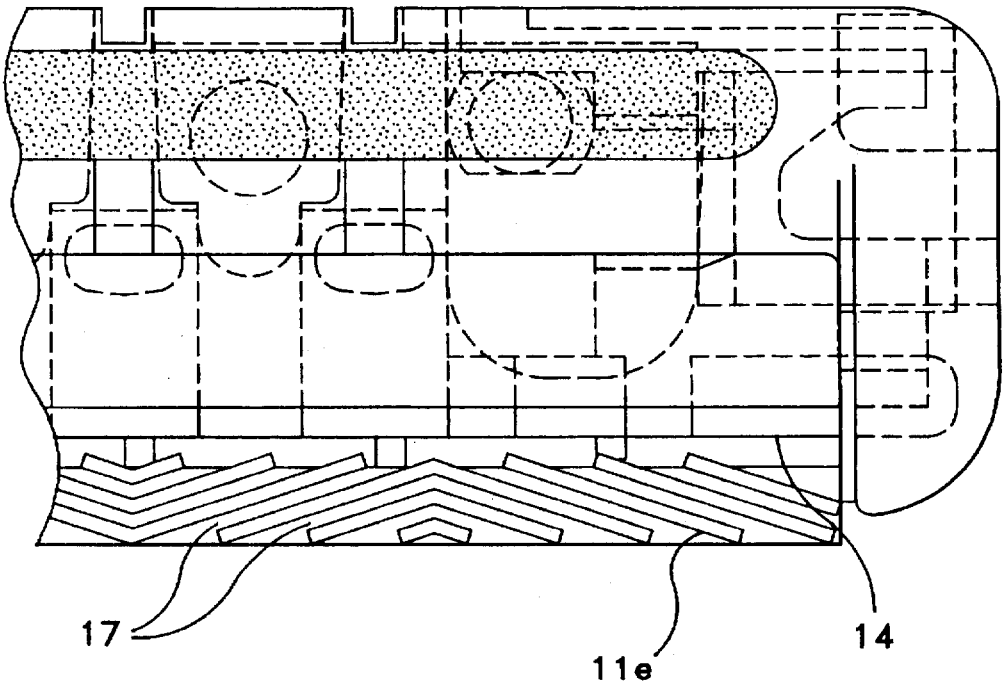
FIG. 13 is a partial, top view of a razor cartridge containing a ninth embodiment of the invention.

FIG. 13 shows a skin-contacting element in the form of a plurality of ridges 11e, in which adjacent segments of ridges 11e are oriented at angles of +20° and −20°, respectively, relative to the direction of the edge of razor blade 14. Adjoining segments of ridges 11c meet to form a plurality of chevron-shape nodes. The ridges 11e may have a thickness on the order of 0.010 inches (0.25 mm) and a spacing between rows of 0.005 inches (0.12 mm).

Figure 14:
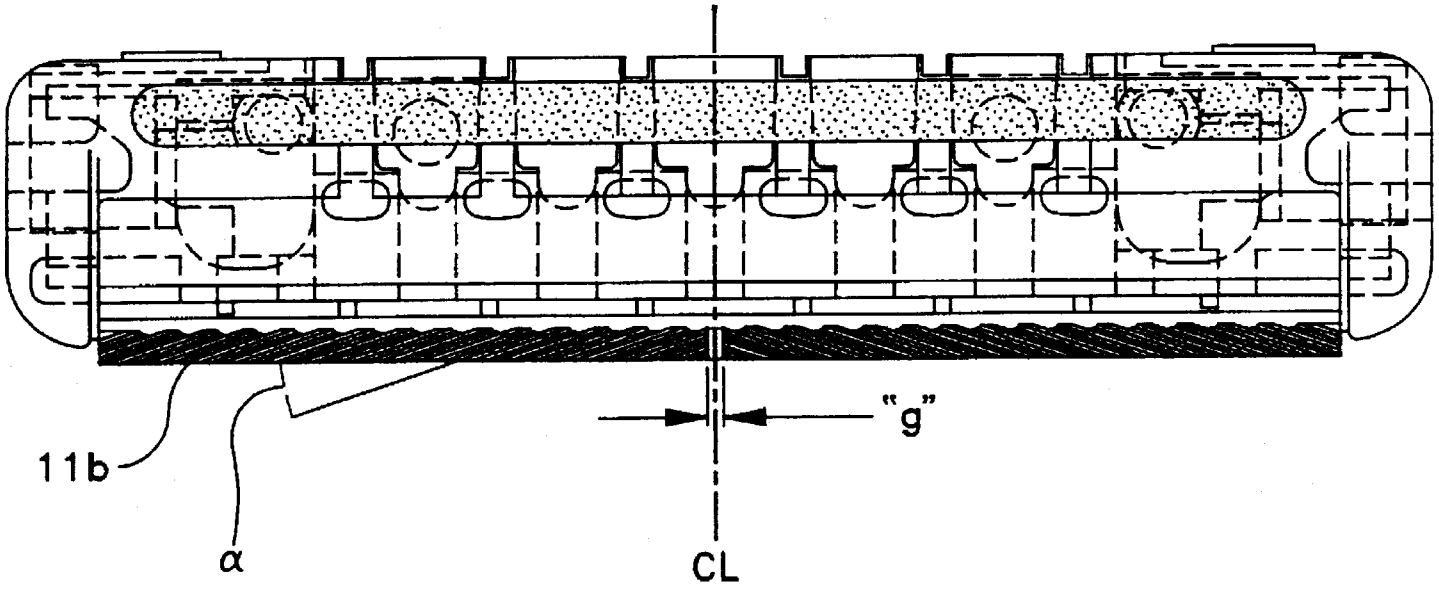
FIG. 14 is a top view of a razor cartridge containing an tenth embodiment of the invention.

In FIG. 14, the rows of ridges 11b are similar, in cross-section, to the rows of ridges 11a in FIGS. 1–4. However, unlike FIGS. 1–4, where the ridges 11a are arranged in a herringbone pattern, in FIG. 15 the ridges 11b to the left of the centerline CL are parallel to one another, and extend in a direction +α, whereas the ridges 11b to the right of the centerline CL extend in a direction −α. A gap "g", e.g., of 0.020 inches (0.51 mm), located at the centerline CL, may separate the two sections of ridges 11b. Alternatively, the two sections of ridges 11b can meet at the centerline CL in a chevron configuration, similar to the adjoining segments A–F of FIGS. 1–4.

As shown in the drawings, in each embodiment the ridges form a plurality of flow-through channels 17 across the guard (or cap). And, in each of the embodiments, the ridges lie alternately at positive and negative angles relative to the blade edge, although it is within the scope of the invention to form the ridges so that they all lie at a positive (or negative) angle, or at the same positive (or negative) angle.

As also shown in the FIG. 4, preferably the cap 16 includes a recess 40 in which a shaving aid 21 is applied. As used herein, the term "shaving aid" refers equally to either a shave-aiding agent combined with a solid, water-soluble micro-encapsulating or micro-porous structure which retains the agent, or to that agent itself being a water-soluble solid.

Exemplary materials constituting shaving aid 21 may comprise one or various combinations of the following:

A. A lubricating agent for reducing the frictional forces between the razor and the skin, e.g., a micro-encapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium larnyl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

H. Essential oils.

I. Vitamin E, e.g. in a formulation of vitamin E acetate, sodium pyruvate, and sunflower oil, contained on a polytrap bead carrier.

The configuration of shaving aid, its place of application to the razor cartridge, the manner of attachment and/or other means and method of incorporation may vary widely to fit particular requirements.

Microencapsulation has been developed to the extent that it may be used to controllably release a large variety of agents including various oils such as silicone oil. Additional information concerning the technology of microencapsulation may be obtained from "Microencapsulation", pages 420–437 in "The Theory & Practice of Industrial Pharmacy", Second Edition, 1970, 1976, published by Lea & Febiger, which is incorporated herein by reference. Further, publication by Union Carbide Corporation of May 1977, entitled "Polyox, Water Soluble Resins: Forming Association Compounds" teaches, at page 11, the use of polyethylene oxide for microencapsulating water-immiscible oils and, at page 17, the use of gelatin and polyethylene oxide to form soluble films for microencapsulation applications, also incorporated by reference.

Another Union Carbide Corporation publication of May 1972, entitled "Polyox, Water Soluble Resins: Thermoplastic Processing: Calendering, Extrusion, and Injection Molding", discloses a basic process for injection molding items using polyethylene oxide. That publication also describes the formation of calendered films and sheets of polyethylene.

U.S. Pat. Nos. 3,075,033 and 3,181,973 provide examples of ways in which polyethylene oxide may be mixed with an insoluble thermoplastic (such as polystyrene of which cap 22 and seat 12 herein are often made) and then formed into a plasticized mass. The polyethylene oxide is then released from the mass by the application of water.

The aforementioned "The Theory & Practice of Industrial Pharmacy", in Chapters 10 and 11 entitled "Compaction & Compression" and "Tablets", respectively, pages 296–358, discloses a variety of compression and/or compaction techniques which, with binders, may be used to form tablets or bars of a large variety of materials.

The foregoing discloses techniques by which shave-aiding agents, such as silicone oil, may be microencapsulated in water soluble capsules. Such microcapsules may then be mixed with a cement or binder and adhered to an appropriate surface of razor cartridge. Also disclosed are various techniques by which polyethylene oxide may be formed in a matrix with other materials, such as polystyrene, or formed into sheets or strips which may be adhered to an appropriate surface of razor cartridge.

These embodiments of the invention have been selected only to exemplify basic approaches to applying the shaving aid either in rod, strip or particle form. As it will become apparent, the shaving aid may be attached to an outer surface of a razor cartridge, recessed into the cartridge, formed as an integral part of one or more of the basic cartridge components (e.g. its guard bar or a spacer between blades in a twin-blade cartridge) and/or impregnated or dispersed in the material from which one or more of the blade-supporting cartridge components are molded or otherwise formed.

EXAMPLE

Samples of a razor cartridge according to the invention were made and compared against the razor cartridge currently being marketed, which is disclosed in U.S. Pat. No. 5,191,712 and U.S. Pat. No. 5,249,361 (hereafter, "existing product").

The invention sample was a flexible cartridge, as shown in FIGS. 1–4. The skin-contacting element was formed of thermoplastic rubber having a durometer of 45 Shore A. The ridges 11a had a height "h" of 0.025 inches (0.635 mm) and a pitch "p" of 0.020 inches (0.51 mm). The ridges 11a tapered from a thickness "b" of 0.015 inches (0.38 mm) at the base to a the thickness "t" at the tip of 0.005 inches (0.13 mm), and had a spacing "s" of 0.005 inches (0.13 mm) between rows. The skin-contacting element had six sections A–F, as shown in FIG. 1, with a chevron 25, 25*a* at each adjoining section, pointing alternately in opposite directions as shown in FIG. 1*a*. The invention sample and the existing product both had a shaving aid (lubricating strip) in the cap.

The invention sample and existing product were first compared in a dry friction test, in which each razor cartridge rested on its rubber skin-contacting element at a normal shaving angle. The invention sample had approximately 30% greater friction than the existing product, indicating that the rubber used in the invention sample has a higher coefficient of friction than the rubber used in the existing product.

Based upon the dry friction test, it would thus be expected that the invention sample would similarly exhibit greater friction in a wet friction test. In the wet friction test, a layer of shaving cream was applied to the test surface, and the relative resistance to movement of the two samples was observed. Rather than having higher friction than the existing product, the invention sample was surprisingly found to move across the surface with considerably less resistance than the existing product.

The applicants believe that such results are due to the fact that the fins of the existing product, which are relatively flexible and extend continuously across the guard, act like a wiper blade or squeegee, wiping off the shaving cream and lubricant from the shaving surface. As a result, the blades and cap move across a surface in which a substantial portion of the lubricants have been removed. In contrast, the invention sample has flow-through channels that leave more of a lubricating film on the face.

The foregoing represents a description of the preferred embodiments. Variations and modifications will be apparent to persons skilled in the art, without departing from the inventive concepts shown herein. For example, while an embodiment of an insert molded cartridge has been described, it is possible to make a cartridge of similar configuration by other techniques. For example, the cap may be formed as a separate element from the seat 20 and guard portion 30, and subsequently assembled around the blade, in the manner described in Motta et al. U.S. Pat. No. 4,443,939. Also, while an example is given of a twin blade cartridge, the shaving cartridge may include only a single blade, more than two blades, or one or more double edge blades. Further, while examples have been given of flexible blade cartridges, the invention may be employed with non-flexible cartridges. Also, the shaving head, rather than being a disposable cartridge, may be integral with a razor handle, such as in the case of disposable plastic razors or injection razors. All such modifications and variations are intended to be within the scope of the invention, as defined in the following claims.

I claim:

1. A shaving implement for moving in a normal shaving direction, comprising:

at least one razor blade having a blade edge extending in a direction perpendicular to said shaving direction;

a shaving head which secures said at least one razor blade; and said shaving head including a skin-contacting element having leading and trailing edges parallel to said blade edge, wherein said skin-contacting element includes a plurality of adjoining sections, each section comprising a plurality of rows of parallel, flexible skin-engaging ridges, and wherein ridges in adjoining sections extend alternately at positive and negative angles relative to the direction of said blade edge.

2. a shaving implement according to claim 1, wherein said ridges define a plurality of flow-through channels extending from said leading edge to said trailing edge.

3. A shaving implement according to claim 1, wherein said ridges are made of a flexible material.

4. A shaving implement according to claim 1, wherein said skin-contacting element includes a plurality of adjoining sections, and wherein ridges in adjoining sections extend alternately at positive and negative angles relative to the direction of said blade edge.

5. A shaving implement according to claim 4, wherein at least one ridge from each section is joined together with a ridge from an adjoining section, to form a chevron-shaped node between adjoining sections.

6. A shaving implement according to claim 1, wherein at least one ridge from each section is joined together with a ridge from an adjoining section, to form a chevron-shaped node between adjoining sections, the chevron shaped nodes in successive adjoining sections across the skin-contacting element being oriented alternately in opposite directions.

7. A shaving implement according to claim 6, wherein adjoining sections are a mirror image of one another.

8. A shaving implement according to claim 7, wherein said ridges have a skin contacting surface such that different segments push the skin in different directions when shaving.

9. A shaving implement according to claim 1, wherein said ridges have a height "h", and wherein rows in each section have different heights.

10. A shaving implement according to claim 1, wherein the alternating positive and negative angle of said ridges, relative to the direction of said blade edge, is in the range of 10° to 50°.

11. A shaving implement according to claim 10, wherein the values of the alternating positive and negative angles are the same.

12. A shaving implement according to claim 10, wherein ridges in adjoining sections lie alternately at angles of ±20°.

13. A shaving implement according to claim 1, further comprising a guard portion lying forward of said blade edge, said guard portion including said skin-contacting element.

14. A shaving implement according to claim 13, wherein said skin-contacting element includes a base, and wherein said ridges extend outwardly from said base at an angle generally perpendicular to said blade and to the direction of shaving.

15. A shaving implement according to claim 13, wherein said skin-contacting element includes a base, and wherein said ridges extend outwardly from said base at an angle generally parallel to said blade, in the direction of shaving.

16. A shaving implement according to claim 13, wherein said shaving head is flexible in a direction perpendicular to said blade, and wherein said skin-contacting element extends continuously across said guard portion.

17. A shaving implement according to claim 13, wherein said guard portion includes a plurality of individual guard segments, and wherein said skin-contacting element is in the form of a plurality of skin-contacting segments associated with the respective guard segments.

18. A shaving implement according to claim 1, wherein said ridges have a height between 0.56 and 0.71 mm, an aspect ratio (height/base thickness) between 1.5 and 1.9, and a pitch between 0.254 and 0.51 mm.

19. A shaving implement according to claim 18, wherein said ridges are formed of a material having a durometer (Shore A scale) between 30 and 90.

20. A shaving implement according to claim 18, wherein said ridges have a height of 0.635 mm and a pitch of 0.51 mm, taper from a base thickness of 0.38 mm to a thickness at the tip of 0.13 mm, and have a spacing of 0.013 mm between rows.

21. A shaving implement according to claim 20, wherein said ridges are formed of a material having a durometer of approximately 45 Shore A scale.

22. A shaving implement according to claim 1, wherein said shaving head further comprises a shaving aid for laying down a lubricating film when used for wet shaving.

23. A shaving implement according to claim 1, wherein said ridges extend parallel to one another and substantially perpendicular to said blade edge.

24. A shaving implement comprising:

at least one razor blade having a blade edge extending in a direction;

a shaving head which secures said at least one razor blade, said shaving head being flexible in a direction perpendicular to said razor blade; and said shaving head including a skin-contacting element having leading and trailing edges parallel to said blade edge, wherein said skin-contacting element includes a flexible base secured to said shaving head and a plurality of skin engaging members extending from said strip, and wherein said skin engaging members define a plurality of flow-through channels extending from said leading edge to said trailing edge.

25. A shaving implement according to claim 24, further comprising a guard portion lying forward of said blade edge, said guard portion including said skin-contacting element.

26. A shaving implement comprising:

at least one razor blade having an edge;

a shaving head made of a relatively rigid plastic material, wherein said shaving head secures said at least one razor blade and includes a cap portion and a guard portion; wherein at least one of said guard and cap portions has a recess including a seat portion and a joint-forming portion;

an elastomeric skin-contacting element filling said recess and joint-forming portion to form a mechanical joint with said at least one cap and guard portion, wherein said skin-contacting element includes a skin engaging surface projecting from said recess and wherein said skin engaging surface comprises a plurality of flexible ribs extending forward of said guard portion and parallel to said blade edge.

27. A shaving implement according to claim 26, wherein said skin-contacting element is insert molded onto said guard portion, and is disposed forward of, and below, said blade edge.

28. A shaving implement according to claim 27, wherein said guard portion includes an outermost guard surface lying generally along a tangent between said cap portion and resilient skin-contacting element.

29. A shaving implement according to claim 26, wherein said joint-forming portion is dovetail shaped.

30. A shaving implement according to claim 27, wherein said guard portion comprises a plurality of guard segments arranged parallel to said blade edge and having gaps therebetween; and wherein said skin-contacting element comprises a skin-contacting element segment associated with each guard segment.

31. A shaving implement according to claim 30, wherein each said guard segment includes a recess including a seat portion and a joint-forming portion, and wherein said skin-contacting segments are insert molded to fill said recess and form a joint with said joint-forming portion.

32. A shaving implement according to claim 31, wherein said joint-forming portion is dovetail shaped.

33. A shaving implement according to claim 26, wherein said skin engaging surface comprises a plurality of flexible ribs extending perpendicular to said blade and parallel to said blade edge.

34. A shaving implement according to claim 26, wherein said skin engaging surface comprises an array of flexible ridges.

35. A shaving implement according to claim 26, wherein said skin engaging surface comprises a plurality of flexible ribs oriented generally perpendicular to said blade edge.

36. A shaving implement according to claim 26, wherein said skin engaging surface comprises a plurality of elliptical bulges.

37. A shaving implement according to claim 26, wherein said skin-contacting element is disposed in said cap.

38. A shaving implement according to claim 26, wherein said shaving head secures a pair of razor blades, and wherein said skin-contacting element is disposed between said blades.

39. A shaving implement according to claim 26, further comprising a second skin-contacting element disposed in said cap.

40. A shaving implement according to claim 26, wherein said skin-contacting element is formed of a material that will chemically bond with said shaving head.

* * * * *